US008681055B2

(12) United States Patent
Kosugi et al.

(10) Patent No.: US 8,681,055 B2
(45) Date of Patent: Mar. 25, 2014

(54) COUPLING STRUCTURE FOR ANTENNA DEVICE

(75) Inventors: Masanori Kosugi, Aichi (JP); Taketoshi Sakurai, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 413 days.

(21) Appl. No.: 12/774,468

(22) Filed: May 5, 2010

(65) Prior Publication Data

US 2010/0289720 A1 Nov. 18, 2010

(30) Foreign Application Priority Data

May 13, 2009 (JP) ..... 2009-117083

(51) Int. Cl.
*H01Q 1/22* (2006.01)
*H01Q 1/50* (2006.01)

(52) U.S. Cl.
USPC ..... 343/702; 343/720; 343/904

(58) Field of Classification Search
USPC ..... 343/702, 790, 890–892, 904, 905, 906, 343/720, 841
See application file for complete search history.

(56) References Cited

U.S. PATENT DOCUMENTS

| | | | | |
|---|---|---|---|---|
| 4,975,713 | A * | 12/1990 | Sheriff | 343/795 |
| 5,994,977 | A * | 11/1999 | Taya | 333/111 |
| 6,603,432 | B2 * | 8/2003 | Hill et al. | 343/702 |
| 6,996,421 | B2 * | 2/2006 | Kaegebein | 455/562.1 |
| 8,269,674 | B2 * | 9/2012 | Camacho et al. | 343/702 |
| 2004/0041735 | A1 | 3/2004 | Sugimoto et al. | |

FOREIGN PATENT DOCUMENTS

| | | |
|---|---|---|
| JP | 2001315583 | 11/2001 |
| JP | 2003-8331 | 1/2003 |
| JP | 2004-306677 A | 11/2004 |
| JP | 2006-213132 A | 8/2006 |

* cited by examiner

*Primary Examiner* — Michael C Wimer
(74) *Attorney, Agent, or Firm* — Patterson Thuente Pedersen, P.A.

(57) ABSTRACT

A coupling structure for an antenna device including a housing, which retains an antenna element for transmitting or receiving a communication signal, and a wire harness, which extends out of the housing. The coupling structure includes a coupling member that couples the wire harness to a conductor when coupling the housing to a coupling location.

6 Claims, 4 Drawing Sheets

COUPLING STRUCTURE FOR ANTENNA DEVICE

CROSS-REFERENCE TO RELATED APPLICATIONS

This application is based upon and claims the benefit of priority from prior Japanese Patent Application No. 2009-117083, filed on May 13, 2009, the entire contents of which are incorporated herein by reference.

BACKGROUND OF THE INVENTION

The present invention relates to a coupling structure for an antenna device that transmits or receives various types of radio waves.

An electronic key system installed in a vehicle uses an electronic key as a vehicle key that transmits a unique key code through wireless communication to the vehicle. One type of such an electronic key system is a wireless key system that requires the operation of a button to transmit the key code. In such a wireless key system, when a lock button of the electronic key is pushed, a lock request radio wave, which includes a key code, is transmitted from the electronic key. Upon receipt of the lock request radio wave, the vehicle locks the unlocked doors if the key code in the radio wave is correct. When an unlock button of the electronic key is pushed, an unlock request radio wave, which includes the key code, is transmitted from the electronic key. When the key code in the radio wave is correct, the vehicle unlocks the locked doors.

The electronic key system includes an antenna, which is installed in the vehicle to receive various types of radio waves transmitted from the electronic key. One example of such an antenna is an inverted L antenna. The inverted L antenna has the shape of inverted letter L from the alphabet. Japanese Laid-Open Patent Publication No. 2003-8331 describes an example of an inverted L antenna. FIG. 1 is a schematic diagram showing the structure described in the publication. As shown in the drawing, an antenna device 105 includes an inverted L antenna 110. The inverted L antenna 110 includes a generally U-shaped antenna element 112, which has a vertical end extending orthogonal to a substrate 107 and a horizontally extending portion bent twice by 90 degrees. The antenna element 112 is arranged on a conductive surface, which is larger than the antenna element 112, and has a length set to be, for example, one fourth the wavelength. In this case, the vehicle body or substrate that is larger than the wavelength functions as the conductive surface. As the size of the conductive surface becomes greater than the wavelength, the antenna properties are further stabilized.

A wire harness 130 is connected to the substrate 107, on which the antenna 100 is mounted, to connect the antenna device 105 to another device. However, when coupling the antenna device 105 to a vehicle body or the like, the layout situation (e.g., length and position) of the wire harness 130 differs in accordance with the application. For example, the length of the antenna element 112 is determined by the wavelength. However, when the antenna device 105 is required to be reduced in size, the substrate 107 must also be miniaturized. Further, in the inverted L antenna 110, the antenna element 112 does not function as an antenna by itself. Rather, the antenna element 112 affects the substrate 107 to function in the same manner as a dipole. Thus, the image produced on a ground plane of the substrate 107 affects the antenna properties. Moreover, the conductive surface may have an area that is not sufficiently larger than the wavelength. In such a case, when the layout situation of the wire harness 130 differs depending on the application, the wire harness 130, which is a conductor, functions as the ground plane and may thereby vary the antenna directivity. This may destabilize the antenna properties. Accordingly, it is required that the antenna properties be stabilized in an antenna device that is connected to a wire harness.

SUMMARY OF THE INVENTION

The present invention provides a coupling structure for an antenna device connected to a wire harness that stabilizes the antenna properties.

One aspect of the present invention is a coupling structure for an antenna device including a housing, which retains an antenna element for transmitting or receiving a communication signal, and a wire harness, which extends out of the housing. The coupling structure includes a coupling member couplable to the wire harness and to a conductor for coupling the housing to a coupling location.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

An antenna device embodied in a reception antenna 5 will now be discussed with reference to FIGS. 2 to 4.

Figure 1:
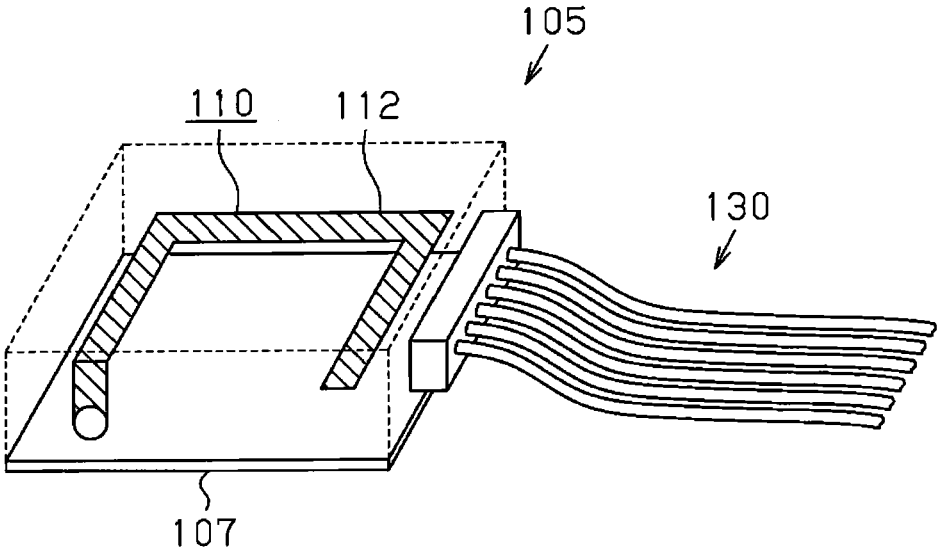
Fig.1 (Prior Art)
FIG. 1 is a schematic diagram showing an antenna device of the prior art.
Figure 2:
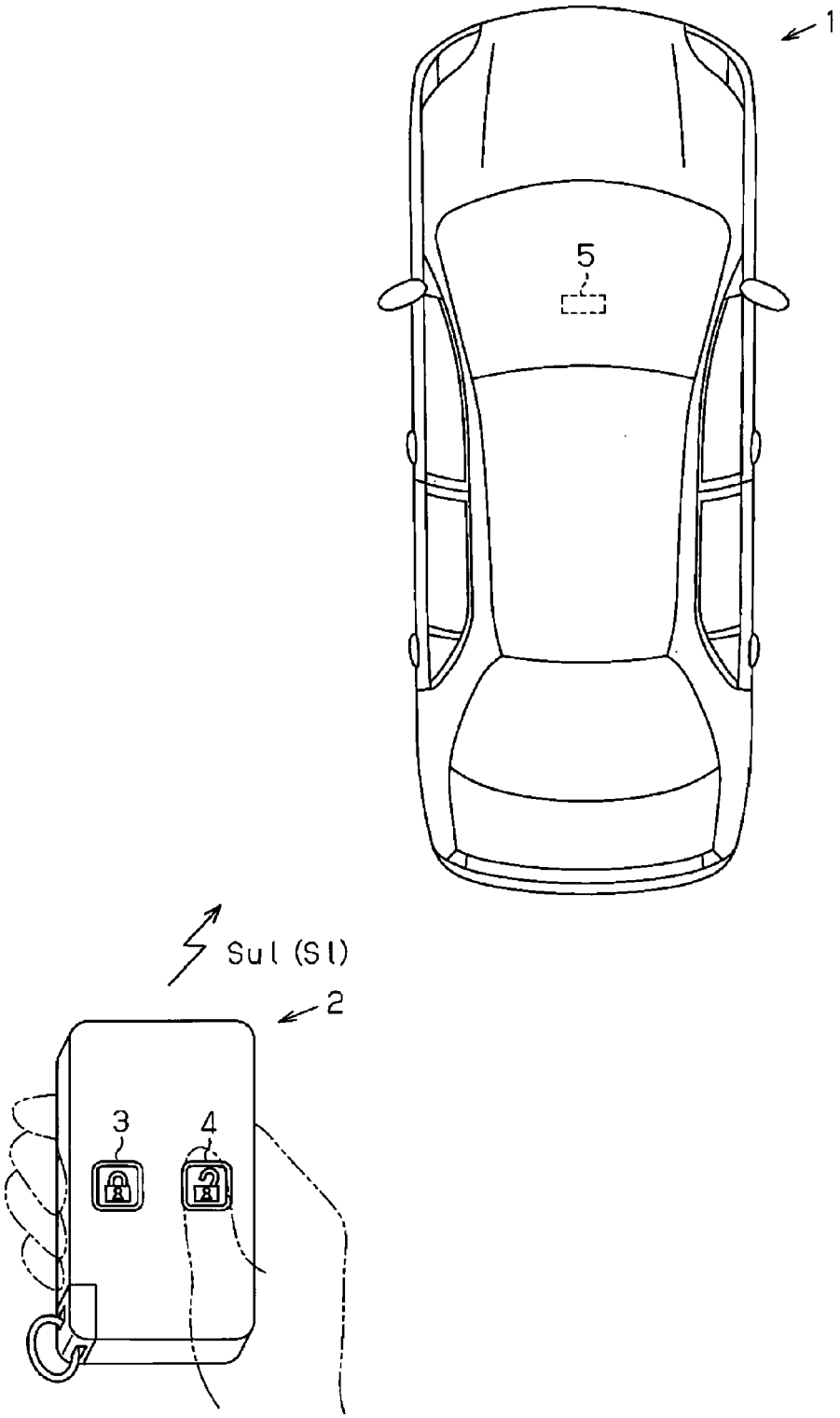
FIG. 2 is a schematic diagram showing an electronic key system.

Referring to FIG. 2, a wireless key system, which is one type of an electronic key system, is installed in a vehicle 1. The wireless key system includes a wireless key 2, which transmits a unique key code through wireless communication when a button is operated. The wireless key 2, which functions as an electronic key, uses the radio frequency (RF) band as a communication frequency that carries signals. The wireless key 2 includes a lock button 3, which is operated to lock a door (close a door lock) of the vehicle 1, and an unlock button 4, which is operated to unlock the door (open the door lock) of the vehicle 1. The reception antenna 5 is installed in the vehicle 1 and thereby functions as a vehicle antenna. The reception antenna 5 corresponds to an antenna device.

In the wireless key system, when the lock button 3 of the wireless key 2 is pushed, the wireless key 2 transmits a lock request radio wave S1 as an RF band signal to the vehicle 1. The lock request radio wave S1 includes a key code of the wireless key 2 and a lock request code for instructing the vehicle 1 to perform locking. When the reception antenna 5 receives the lock request radio wave S1, the vehicle 1 performs key verification with the key code included in the lock request radio wave S1. When the key verification is successful, the door of the vehicle 1 is locked in accordance with the lock request code. When the unlock button 4 of the wireless key 2 is pushed, the wireless key 2 transmits an unlock request radio wave Su1 as an RF band signal to the vehicle 1. The unlock request radio wave Su1 includes the key code of the wireless key 2 and an unlock request code for instructing the vehicle 1 to perform unlocking. When the reception antenna 5 receives the unlock request radio wave Su1, the vehicle 1 performs key verification with the key code included in the unlock request radio wave Su1. When the key verification is successful, the door of the vehicle 1 is unlocked in accordance with the unlock request code.

Figure 3:
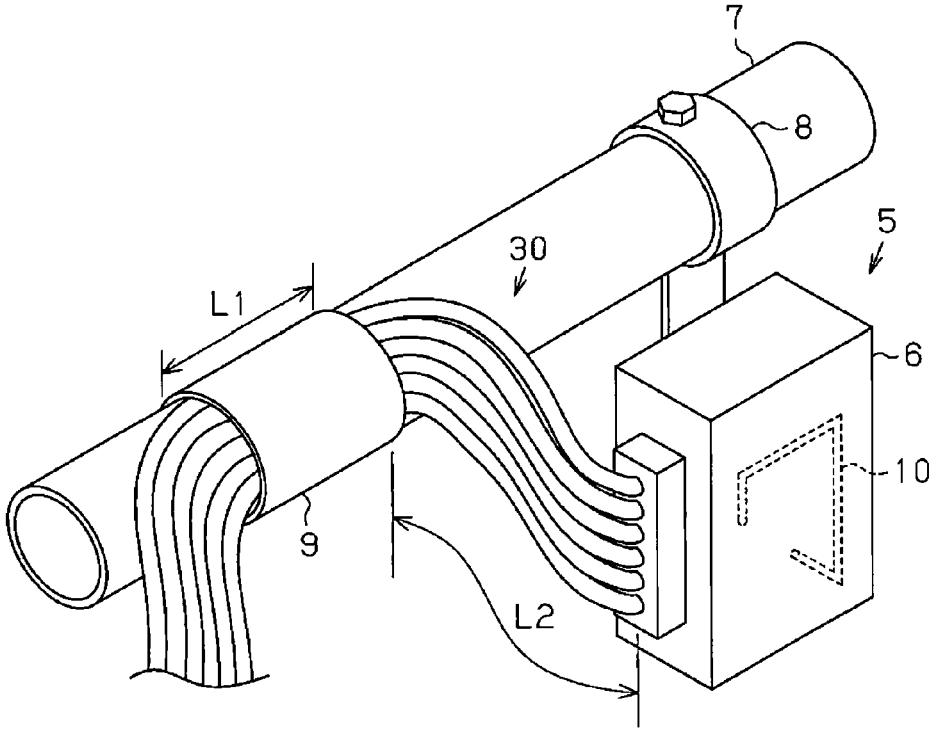
FIG. 3 is a schematic diagram showing a coupling structure for an antenna device according to one embodiment of the present invention.

Referring to FIG. 3, the reception antenna 5 includes an antenna element 10, which is retained in a housing 6. The housing 6 is mounted on a vehicle body to couple the reception antenna 5 to the vehicle 1. The reception antenna 5 is fixed to, for example, a metal pipe 7 by an annular fastener 8. The metal pipe 7 corresponds to a coupling location and a conductor.

The reception antenna 5 is connected to a wire harness 30, which is connected to another device in the vehicle 1 or a power supply. When coupling the reception antenna 5 to the vehicle body, the wire harness 30 is coupled to the metal pipe 7 by a shrink tube 9, which functions as a coupling member. The metal pipe 7 and the wire harness 30 extend through and heat the shrink tube 9. This shrinks the shrink tube 9 and fastens the metal pipe 7 and the wire harness 30. The shrink tube 9 has a length L1 in the direction in which the wire harness 30 extends that is set to be greater than or equal to one eighth of a wavelength of the received signal. Further, the shrink tube 9 is attached to the metal pipe 7 at a position where the wire harness 30 is extended from the housing 6 of the reception antenna 5 to the shrink tube 9 over a length L2 that is one fourth of the wavelength of the received signal. Due to the shrink tube 9, the wire harness 30 and the metal pipe 7 are in contact with each other.

In a reception antenna of the prior art, a conductive wire harness may function as a ground plane of the antenna depending on the layout situation of the wire harness. This may vary and destabilize the antenna properties. To solve this problem, in the reception antenna 5 of the present example, the electric field generated by the wire harness 30 is concentrated at the metal pipe 7 where the wire harness 30 is fastened. Thus, the antenna properties do not vary even when the layout situation of the wire harness 30 is changed. This stabilizes the antenna properties. In other words, the antenna properties are not dependent on the layout situation of the wire harness 30.

The antenna directivity of the reception antenna 5 is an index that indicates the reception sensitivity of the reception antenna 5 with respect to various radio waves transmitted from the wireless key 2. More specifically, the antenna directivity is indicated by a value representing the reception sensitivity with respect to the direction of the antenna element 10. A higher antenna directivity value indicates a higher reception sensitivity. The ideal antenna directivity is round (circular) so that whichever direction the wireless key 2 transmits a radio wave to the antenna element 10 (vehicle 1), the transmitted radio wave reaches the antenna element 10 from about the same distance. Thus, in this type of the reception antenna 5, there is a demand that the antenna directivity be as round as possible. A rounder antenna directivity improves the antenna properties.

When discussing the antenna directivity, the antenna directivity roundness on a plane extending in the horizontal direction (horizontal plane), which serves as a reception plane of the antenna element 10 in the vehicle 1, must be taken into consideration. The wireless key 2 is used to transmit radio waves in the horizontal direction near the vehicle 1 (in a direction extending along the ground plane). Thus, the radio wave transmission direction of the wireless key 2 extends along a horizontal plane.

Figure 4:
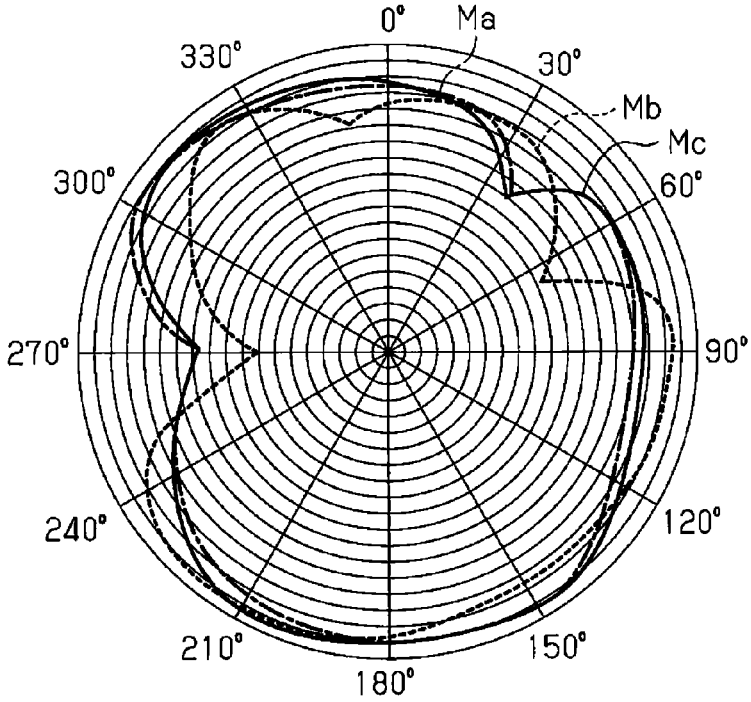
FIG. 4 is a waveform chart showing the antenna directivity of a horizontal polarized wave on a horizontal plane.

FIG. 4 is a chart showing the waveforms of the antenna directivity of the reception antenna 5 in the present example. In the chart of FIG. 4, the marks in the circumferential direction represent the angle (0 degrees to 360 degrees) and the marks in the radial direction represent the reception sensitivity. In the chart, the single-dashed line shows a waveform Ma indicating the antenna directivity for the reception antenna of the prior art and the reception antenna 5 of the present example when the wire harness 30 is arranged at the desired position, that is, the originally designed position. The broken line shows a waveform Mb indicating the antenna directivity for the reception antenna of the prior art when the wire harness is not arranged at the desired position, that is, when the wire harness is displaced within a tolerance. The solid line shows a waveform Mc indicating the antenna directivity for the reception antenna 5 of the present example when the wire harness 30 is not arranged at the desired position, that is, when the wire harness 30 is displaced within a tolerance.

The waveform Mb, which is for the reception antenna of the prior art when the wire harness is not arranged at the desired position, is more greatly deviated from a circle than the waveform Ma, which is for the reception antenna of the prior art and the reception antenna 5 of the present example when the wire harness 30 is arranged at the desired position. However, the waveform Mc, which is for the reception antenna 5 of the present example when the wire harness 30 is not arranged at the desired position, varies subtly from the waveform Ma, which is for the reception antenna 5 of the present example when the wire harness 30 is arranged at the desired position. This shows that the layout situation of the wire harness 30 is unaffected by the directivity of the reception antenna 5.

The antenna device of the embodiment discussed above has the advantages described below.

(1) When attaching the housing 6 to the metal pipe 7, the shrink tube 9 couples the wire harness 30 to the metal pipe 7. Accordingly, the electric field generated by the wire harness 30 is concentrated at the metal pipe 7 where the wire harness 30 is fastened. Thus, the antenna properties do not vary even when the layout situation of the wire harness 30 is changed. This stabilizes the antenna capability.

(2) The shrink tube 9 couples the wire harness 30 to the metal pipe 7 at a position at which the wire harness 30 is extended from the housing 6 by the length L2, which is one fourth of the wavelength. This concentrates the electric field at the metal pipe 7 at a location corresponding to one fourth of the wavelength where the antenna element 10 resonates.

(3) The shrink tube 9 couples the wire harness 30 to the metal pipe 7 in contact with the metal pipe 7. This further concentrates the electric field at the location of contact between the wire harness 30 and the metal pipe 7.

(4) The length L1 of the shrink tube 9 is set to be greater than or equal to one eighth of a wavelength in the direction that the wire harness 30 extends along the metal pipe 7. This structure concentrates the electric field at the metal pipe 7 and suppresses the generation of an electric field at other locations.

It should be apparent to those skilled in the art that the present invention may be embodied in many other specific forms without departing from the spirit or scope of the invention. Particularly, it should be understood that the present invention may be embodied in the following forms.

The coupling member for coupling the wire harness 30 (i.e., the metal pipe 7 in the above-described embodiment) is not limited to the shrink tube 9 and may instead be, for example, vinyl tape. In other words, the coupling member may be a non-metal member or a metal member. Further, the coupling member does not have to have a cylindrical shape. The coupling member just needs to fasten the wire harness to the conductor and does not need to electrically couple the wire harness to the conductor. Further, the coupling member does not have to couple the wire harness to the conductor in contact with the conductor. However, it is preferred that the wire harness and conductor be in contact with each other to effectively concentrate the electric field at the conductor. In this case, the coupling member is used so that an outer coating of the wire harness contacts the conductor, and the wire harness does not have to be electrically coupled to the wire harness.

The length of the coupling member (in the above-described embodiment, the length L1 of the shrink tube 9) does not have to be greater than or equal to one eighth of the wavelength. The coupling member is formed so that the wire harness 30 is coupled to the conductor (in the above-described embodiment, the metal pipe 7) over a length that is substantially greater than or equal to one eighth of the wavelength. Thus, the coupling member may be formed from two or more members.

The length of the wire harness 30 coupled by the coupling member (in the above-described embodiment, the shrink tube 9) may be less than one eighth of the wavelength. That is, the length of the coupling member (shrink tube 9) may be less than one eighth of the wavelength. Such a structure also concentrates the electric field at the conductor and is thus superior to the prior art structure from the viewpoint of stabilization of the antenna properties. However, to effectively concentrate the electric field, it is preferred that the length L1 be one eighth of the wavelength.

The wire harness 30 does not necessarily have to be in contact with the metal pipe 7 and may be arranged near the metal pipe 7. That is, the coupling member (in the above-described embodiment, the shrink tube 9) may couple the wire harness 30 in a state spaced apart from the conductor (in the above-described embodiment, the metal pipe 7).

The position at which the coupling member (in the above-described embodiment, the shrink tube 9) couples the wire harness 30 to the conductor (in the above-described embodiment, the metal pipe 7) is not limited to the location where the length of the wire harness 30 from the housing 6 is one fourth of the wavelength. However, to effectively concentrate the electric field at the conductor, it is preferred that the length from the housing 6 be one fourth of the wavelength.

Figure 5:
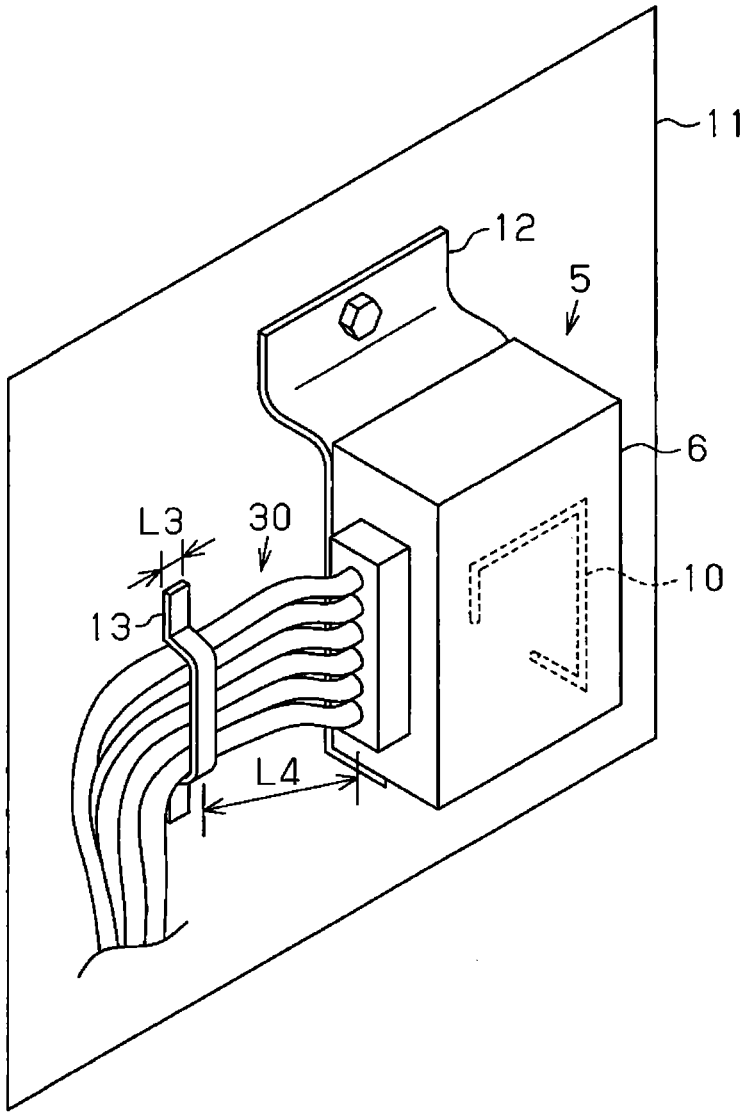
FIG. 5 is a perspective view showing a further coupling structure for the antenna device shown in FIG. 3.

The conductor to which the housing 6 and wire harness 30 of the reception antenna 5 are coupled is not limited to the metal pipe 7 and may be another conductor. For example, as shown in FIG. 5, the conductor may be a frame panel 11 (flat panel) of the vehicle body. In this case, the housing 6 is fastened to the frame panel 11 by, for example, a plate-shaped fastener 12. The wire harness 30 is coupled to the frame panel 11 by a U-shaped coupling member 13, which is formed from, for example, acrylonitrile butadiene styrene (ABS) resin. The coupling member 13 has a length L3 in the direction that the wire harness 30 extends that is preferably set to be greater than or equal to one eighth of the wavelength. Thus, the antenna properties do not vary, and the antenna capability is stabilized. Further, the wire harness 30 has a length L4 between the housing 6 of the reception antenna 5 and the coupling member 13 that is preferably set to be one fourth of the wavelength. Additionally, the wire harness 30 and the frame panel 11 are preferably held in contact with each other by the coupling member 13. This structure also concentrates the electric field generated by the wire harness 30 at the frame panel 11. Accordingly, the antenna properties do not vary even when the layout situation of the wire harness 30 is changed, and the antenna capacity is stabilized.

In the above-described embodiment, a single coupling member, such as the metal pipe 7 (refer to FIG. 3) or the frame panel 11 (refer to FIG. 5), is used as the coupling location for the housing of the antenna device and the conductor to which the wire harness 30 is coupled. However, discrete members may be used as the coupling location for the housing and the conductor.

The antenna element 10 is not limited to an inverted L antenna and may be a monopole antenna. Alternatively, the antenna element 10 may be a T antenna or any antenna of which the antenna properties are affected by an image produced in a ground plane of a substrate.

The antenna device is not limited to the reception antenna 5 and may be, for example, a transmission antenna. Alternatively, the antenna device may be a transmission-reception antenna that is used for both signal transmission and signal reception. In such a case, one fourth of the wavelength refers to one fourth of a wavelength of a transmission-reception signal, and one eighth of a wavelength refers to one eighth of a wavelength of the transmission-reception signal.

The electronic key system is not necessarily limited to a wireless key system and may be a key-operation-free system that automatically transmits a key code from an electronic key (vehicle key). In such a key-operation-free system, the vehicle continuously or intermittently transmits a key code reply request. In response to the request, the electronic key returns a key code to the vehicle 1.

The antenna device (reception antenna 5 or the like) does not have to be installed in the vehicle 1 and may be used in any device or apparatus that performs wireless communication.

The present examples and embodiments are to be considered as illustrative and not restrictive, and the invention is not to be limited to the details given herein, but may be modified within the scope and equivalence of the appended claims.

What is claimed is:

1. A coupling structure for an antenna device including a housing, which retains a substrate connected to an antenna element for transmitting or receiving a communication signal, and a wire harness which extends out of the housing, the wire harness connected to the substrate, the coupling structure comprising:

a coupling member that couples a portion of the wire harness to a conductor spaced apart from the housing, the coupling member fastening the wire harness to the conductor and causing the wire harness to be electromagnetically coupled with the conductor at the coupling member through an outer coating of the wire harness, wherein the coupling member is positioned on the conductor such that a first length of the wire harness extending from the housing to the coupling member is one fourth of a wavelength of the communication signal, and wherein the coupling member fastens the wire harness in close proximity to the conductor over a second length of the wire harness extending from the first length so as to cause the wire harness to be electromagnetically coupled with the conductor, the second length being at least one eighth of the wavelength of the communication signal and less than the first length.

2. The coupling structure according to claim 1, wherein the coupling member is arranged to couple the wire harness in contact with the conductor.

3. The coupling structure according to claim 1, wherein the coupling member has a length that is greater than or equal to one eighth of the wavelength in the direction that the wire harness extends.

4. The coupling structure according to claim 1, wherein the conductor is a metal pipe, and the coupling member is formed by a tube that fastens the wire harness to the metal pipe.

5. The coupling structure according to claim 1, wherein the conductor is a flat panel, and the coupling member is formed by a U-shaped member that fastens the wire harness to the flat panel.

6. The coupling structure according to claim 1, further comprising a fastener that fastens the housing to the conductor at a first conductor location, wherein the coupling member couples the portion of the wire harness to the conductor at a second conductor location, the first conductor location being different than the second conductor location.

* * * * *